US009222668B2

(12) United States Patent
Zink et al.

(10) Patent No.: US 9,222,668 B2
(45) Date of Patent: Dec. 29, 2015

(54) LOW $NO_x$ BURNER APPARATUS AND METHOD

(71) Applicant: ZEECO, INC., Broken Arrow, OK (US)

(72) Inventors: Darton J. Zink, Tulsa, OK (US); Rex K. Isaacs, Tulsa, OK (US); John Philip Guarco, Granby, CT (US); Frank E. Beale, Broken Arrow, OK (US); John McDonald, Broken Arrow, OK (US); Cody L. Little, Coweta, OK (US); Seth Marty, Broken Arrow, OK (US); Ryan Roberts, Tulsa, OK (US)

(73) Assignee: ZEECO, INC., Broken Arrow, OK (US)

( * ) Notice: Subject to any disclaimer, the term of this patent is extended or adjusted under 35 U.S.C. 154(b) by 406 days.

(21) Appl. No.: 13/672,791

(22) Filed: Nov. 9, 2012

(65) Prior Publication Data

US 2013/0122440 A1 May 16, 2013

Related U.S. Application Data

(60) Provisional application No. 61/558,281, filed on Nov. 10, 2011.

(51) Int. Cl.

| | |
|---|---|
| ***F23D 14/22*** | (2006.01) |
| ***F23D 14/84*** | (2006.01) |
| ***F23C 9/00*** | (2006.01) |

(52) U.S. Cl.

CPC ..... *F23D 14/22* (2013.01); *F23C 9/006* (2013.01); *F23D 14/84* (2013.01); *F23C 2202/20* (2013.01)

(58) Field of Classification Search

CPC ..... F23D 14/36; F23D 14/22; F23D 14/20; F23D 14/84; F23C 9/006; F23C 2202/20; F23C 3/002; F23C 2202/40

USPC ..... 431/187

See application file for complete search history.

(56) References Cited

U.S. PATENT DOCUMENTS

| | | | | |
|---|---|---|---|---|
| 4,257,763 | A * | 3/1981 | Reed | 431/188 |
| 4,925,387 | A * | 5/1990 | Locanetto et al. | 431/187 |
| 5,441,404 | A * | 8/1995 | Christenson | 431/187 |
| 6,347,935 | B1 * | 2/2002 | Schindler et al. | 431/5 |
| 6,499,990 | B1 | 12/2002 | Zink | |
| 6,626,661 | B1 | 9/2003 | Zink | |
| 7,670,135 | B1 * | 3/2010 | Zink et al. | 431/9 |
| 2001/0018171 | A1 | 8/2001 | Al-Halbouni | |

* cited by examiner

*Primary Examiner* — Steven B McAllister
*Assistant Examiner* — Rabeeul Zuberi
(74) *Attorney, Agent, or Firm* — Dennis D. Brown; Brown Patent Law, P.L.L.C.

(57) ABSTRACT

A burner apparatus for a furnace system and a method of burner operation. The burner has a series of fuel ejection structures which at least partially surround the burner wall for ejecting fuel into a combustion region projecting from the forward end of the burner wall. The ejection structures preferably eject fuel outside of the burner wall at alternating angles. Further, the burner apparatus preferably includes at least one additional series of fuel ejection structures which is spaced radially outward from the first series of ejection structures.

17 Claims, 4 Drawing Sheets

LOW $NO_x$ BURNER APPARATUS AND METHOD

This application claims the benefit of U.S. Provisional Patent Application Ser. No. 61/558,281 filed on Nov. 10, 2011, and incorporates said provisional application by reference into this document as if fully set out at this point.

FIELD OF THE INVENTION

The present invention relates to burner assemblies and to methods and apparatuses for reducing $NO_x$ emissions from burners of the type used in process heaters, boilers, and other fired heating systems.

BACKGROUND OF THE INVENTION

Many industrial applications require large scale generation of heat from burners for process heaters, boilers, or other fired heating systems. If the burner fuel is thoroughly mixed with air and combustion occurs under ideal conditions, the resulting combustion products are primarily carbon dioxide and water vapor. However, when the fuel is burned under less than ideal conditions, such as in a high temperature environment, nitrogen present in the combustion air reacts with oxygen to produce nitrogen oxides ($NO_x$). It is well known that, other conditions being equal, $NO_x$ production increases as the temperature of the combustion process increases. $NO_x$ emissions are generally considered to contribute to ozone depletion and other environmental problems.

For gaseous fuels with no fuel bound nitrogen, thermal $NO_x$ is the primary mechanism of $NO_x$ production. Thermal $NO_x$ is produced when the flame reaches a high enough temperature to break the covalent $N_2$ bond apart and the resulting "free" nitrogen atoms then bond with oxygen to form $NO_x$.

Combustion air is comprised of approximately 21% $O_2$ and 79% $N_2$. Combustion occurs when the $O_2$ reacts and is combined with the fuel (typically hydrocarbon). The temperature of combustion is not normally great enough to break all of the $N_2$ bonds, so most of the nitrogen in the air stream passes through the combustion process and remains as diatomic nitrogen ($N_2$) in the combustion products.

However, some of the $N_2$ reaches high enough temperatures in the high intensity regions of the flame to break apart and form "free" nitrogen. Once the covalent nitrogen bond is broken, the "free" nitrogen is available to bond with other atoms. The free nitrogen, or nitrogen radicals, will react with any other atoms or molecules suitable for reaction. Fortunately, the free nitrogen will most likely react with other free nitrogen to form $N_2$. However, if another free nitrogen atom is not available, the free nitrogen will react with oxygen to form $NO_x$.

As the flame temperature increases, the stability of the $N_2$ covalent bond decreases, allowing the formation of more and more free nitrogen and subsequently increased thermal $NO_x$. Burner designs can reduce $NO_x$ emissions by reducing the peak flame temperature which in turn reduces the formation of free nitrogen available to form $NO_x$.

The varied requirements of refining and petrochemical processes require the use of numerous types and configurations of burners. The method utilized to lower $NO_x$ emissions can differ from application to application. However, thermal $NO_x$ reduction is generally achieved by delaying the rate of combustion. Since the combustion process is a reaction between oxygen and a fuel, the objective of delayed combustion is to reduce the rate at which the fuel and oxygen mix together and burn. The faster the oxygen and the fuel gas mix together, the faster the rate of combustion and the higher the peak flame temperature.

$NO_x$ emissions increase as the adiabatic flame temperature increases. Slowing the combustion reaction allows the flame temperature to be reduced, and as the flame temperature is reduced, so are the thermal $NO_x$ emissions.

One of the best methods of thermal $NO_x$ reduction is to mix the fuel gas together with the inert products of combustion before combustion occurs, thus reconditioning the fuel. Since the new mixture is comprised of inert components, the resulting composition burns at a lower peak temperature.

SUMMARY OF THE INVENTION

The present invention provides a low $NO_x$ burner apparatus and method which satisfy the needs and alleviate the problems discussed above. The inventive burner and method are capable of providing $NO_x$ emission levels of 10 parts per million by volume (ppmv) or less (preferably 7 ppmv or less) based on the total volume of combustion gas product produced by the burner. The inventive low $NO_x$ burner also provides much more stable operation and is less complex and less costly than the low $NO_x$ burner systems currently available. Moreover, the inventive burner is much simpler to maintain and control and provides a desirably broad available operating range. In this regard, the inventive burner can provide a turndown ratio in the range of from about 10:1 to about 20:1 or more.

The inventive burner and method also greatly reduce the need for metal components within the throat of the burner, thus allowing the size of the burner to be significantly reduced. This, coupled with the desirably broad turndown ratio provided by the inventive burner, allows the furnace operator to achieve and maintain more optimum, stable heat flux characteristics and also allows the inventive burner to be more easily sized as needed. Thus, the inventive burner can be conveniently used in existing heaters, boilers, etc. to replace most existing conventional or staged fuel burners with, at most, only minor modifications to the furnace structure.

In one aspect, there is provided a burner apparatus for a furnace system comprising: (a) a burner wall having a forward end and an air passageway extending therethrough, the air passageway having a discharge at the forward end of the burner wall and the burner wall having a longitudinal axis extending through the forward end and (h) a series of fuel ejection structures which at least partially surrounds the burner wall, each of the fuel ejection structures having a fuel ejection port, and the fuel ejection ports of the fuel ejection structures being positioned longitudinally rearward of and laterally outward from the forward end of the burner wall. The fuel ejection ports of a first set of the fuel ejection structures of this series are oriented for ejecting fuel outside of the burner wall at a first angle with respect to the longitudinal axis. The fuel ejection ports of a second set of the fuel ejection structures of this series are oriented for ejecting fuel outside of the burner wall at a second angle with respect to the longitudinal axis which is different from the first angle.

Preferably, the fuel ejection structures of the first set are positioned in an alternating relationship with the fuel ejection structures of the second set in this series of fuel ejection structures. Also, each of the fuel ejection structures preferably has only one fuel ejection port. In addition, the fuel ejection ports of the first set of fuel ejection structures are preferably oriented to eject fuel at an angle toward the burner wall and the fuel ejection ports of the second set of fuel ejection structures are preferably oriented to eject fuel at an angle away from the burner wall.

As used herein, and in the claims, the term "furnace system" refers to and includes boilers, process heaters, and any other type of fired heating system. Also, the term "fuel ejection structure," as used herein and in the claims, refers to and includes any type of ejector, ejector tip, nozzle, or other ejection structure.

In another aspect, the inventive burner assembly preferably comprises: a burner wall having an air passageway therethrough and a combustion region beginning at or near the outer end of the burner wall; a series of primary fuel gas ejection tips or other primary ejection structures which partially surround, substantially surround, or completely surround the burner wall for ejecting primary fuel gas outside the burner wall such that at least most of the primary fuel gas is received in the combustion region; and a series of secondary fuel gas ejection tips or other secondary ejection structures spaced radially outward from the series of primary ejectors which also partially surround, substantially surround, or completely surround the burner wall for ejecting secondary fuel gas outside of the burner wall such that at least most of the secondary fuel gas is received in the combustion region. The primary gas and secondary gas pass through and mix with the inert products of combustion (flue gas) within the furnace housing a "free jet" mixing method. The "free jet" method of mixing maximizes the amount of inert products of combustion which combine with the fuel gas prior to complete combustion.

As will also be understood by those in the art, the term "free jet," as used herein and in the claims, refers to a jet flow issuing from a nozzle into a fluid which, compared to the jet flow, is more at rest. In this case, the fluid issuing from the nozzle is preferably fuel gas, and the fluid substantially at rest is the flue gas present within the heating system. For purposes of the present invention, the heating system can be a process heater, a boiler or generally any other type of heating system used in the art. The flue gas present within the system will comprise the gaseous products of the combustion process. The fuel gas used in the inventive burner and method can be natural gas or generally any other type of gas fuel or gas fuel blend employed in process heaters, boilers, or other gas-fired heating systems. The free jet flow employed in the inventive system operates to entrain flue gas and to thoroughly mix the flue gas with the fuel gas stream as it travels to the combustion region which begins at or near the outlet end of the burner wall.

In another aspect, there is provided a burner apparatus for a furnace system comprising: (a) a burner wall having a forward end and an air passageway extending therethrough, the air passageway having a discharge at the forward end of the burner wall and the burner wall having a longitudinal axis which extends through the forward end; (b) a series of primary fuel ejection structures which at least partially surrounds the burner wall, each of the primary fuel ejection structures having a fuel ejection port, the fuel ejection ports of the primary fuel ejection structures being positioned longitudinally rearward of and laterally outward from the forward end of the burner wall to eject fuel outside of the burner wall; and (c) a series of secondary fuel ejection structures which at least partially surrounds the burner wall, each of the secondary fuel ejection structures having a fuel ejection port, the fuel ejection ports of the secondary fuel ejections structures being positioned longitudinally rearward of and laterally outward from the forward end of the burner wall to eject fuel outside of the burner wall. The series of secondary fuel ejection structures is spaced radially outward from the series of primary fuel ejection structures.

The fuel ejection ports of a first set of the secondary fuel ejection structures can be oriented to eject fuel outside of the burner wall at a first angle with respect to the longitudinal axis and the fuel ejection ports of a second set of the secondary fuel ejection structures can be oriented to eject fuel outside of the burner wall at a second angle with respect to the longitudinal axis which is different from the first angle. In addition, the secondary fuel ejection structures of the first set can be positioned in an alternating relationship with the secondary fuel ejection structures of the second set in the series of secondary fuel ejection structures.

Alternatively, or in addition, the fuel ejection ports of a first group of the primary fuel ejection structures can be oriented to eject fuel at one angle with respect to the longitudinal axis and the fuel ejection ports of a second group of the primary fuel ejection structures can be oriented to eject fuel at an angle different from said one angle.

In another aspect, there is provided a method of operating a burner. The method comprises the steps of: (a) delivering air through a burner wall to a combustion region, at least most of the combustion region being outside of a forward end of the burner wall; (b) ejecting the fuel forwardly outside of the burner wall from a series of primary fuel ejection structures which at least partially surround the burner wall and are positioned rearwardly of, and radially outward from, the forward end of the burner wall, wherein a first set of the primary ejection structures eject fuel forwardly at an initial angle toward the burner wall, a second set of the primary ejection structures eject fuel forwardly at an initial angle away from the burner wall, and the primary ejection structures of the first set are positioned in an alternating relationship with the primary ejection structures of the second set in the series of primary fuel ejection structures; and (c) ejecting fuel forwardly outside of the burner wall from a series of secondary fuel ejection structures which at least partially surround the burner wall and are positioned rearwardly of and radially outward from the forward end of the burner wall, wherein the series of secondary fuel ejection structures is spaced radially outward from the series of primary fuel ejection structures.

Preferably, fuel is ejected forwardly from the primary ejection structures of the first set at an initial angle of from about +10° to about +20° toward the burner wall and fuel is ejected forwardly from the primary ejection structures of the second set at an initial angle of from about −0.5° to about −15° away from the burner wall. Further, fuel is preferably ejected from each of the primary and secondary fuel ejection structures from only a single fuel ejection port.

The inventive burner is preferably an "Internal Flue Gas Recirculation" (IFGR) burner that mixes fuel gas together with the inert products of combustion inside the furnace housing to produce low emissions with preferably little or no "External Flue Gas Recirculation" (EFGR). In addition, the use of staged fuel gas ejection in the inventive burner assembly further reduces $NO_x$ emissions by increasing the amount of inert products of combustion mixed with the fuel gas.

Also, the inventive burner increases the amount of "Internal Flue Gas Recirculation" (IFGR) to thereby reduce thermal $NO_x$ emissions without sacrificing burner performance with respect to flame length, turndown ratio, and stability. The maximization of IFGR to achieve low $NO_x$ emissions also eliminates or significantly reduces many of the problems experienced by other burners which must rely on high levels of "External Flue Gas Recirculation" (EFGR) in order to achieve reduced emissions. Compared to burners which use EFGR, the inventive burner reduces the blower power usage, increases the burner turndown ratio, reduces maintenance costs and requirements, and improves flame quality.

The inventive burner operates in a manner whereby both the primary fuel gas and the secondary fuel gas used in the burner must pass through and mix with the products of combustion (flue gas) within the furnace before complete combustion occurs. This mixing, or fuel conditioning, allows the peak flame temperature of the fuel mixture to be reduced and the thermal $NO_x$ emissions to be lowered. In addition to a series/row of surrounding exterior primary gas tips, the inventive burner also uses a second series/row (or multiple additional series/rows) of exterior surrounding gas tips, called secondary gas tips, wherein the secondary series is spaced radially outwardly from the primary series such that the secondary fuel gas ejected from the secondary tips must travel along a longer path through the internal products of combustion within the furnace housing before reaching the combustion region which preferably begins at or near the outer end of the burner wall. Since the fuel gas passes through more inert products of combustion due to the increased distance to the combustion region, more mixing occurs which changes the composition of the fuel such that the resulting reconditioned fuel mixture is preferably around 80% to 90% inert. The combustion of the highly reconditioned fuel gas thus occurs in a manner which provides more uniform heat distribution at a lower peak temperature with less thermal $NO_x$ emissions.

Additional advantages and benefits of the inventive burner include:

- $NO_x$ emissions less than 20 ppmv without EFGR
- Lower blower power requirements since there is no need for EFGR
- The burner does not require a wind-box and therefore avoids wind-box air flow distribution issues
- Stable flame over a wide range of conditions since, in one respect, stabilization occurs on the burner refractory tile wall
- Gas and air are more uniformly mixed since the gas tips are located around the burner perimeter
- High turndown of 10:1 or greater and, for most cases, even up to 20:1 or higher
- No stabilization metal is required in the burner throat
- Ejector tips preferably have only a single firing port and do not require an ignition port
- Low maintenance cost since the tip mass is small and the tip has minimal exposure to extreme temperature conditions (i.e., the tips typically extend into the furnace less than 1 inch (25 mm))
- Low maintenance cost since the tips preferably do not have ignition ports which are prone to plugging
- Compact size makes this burner well suited for retrofit applications
- Low probability of flame interaction since the burners can be smaller and gas/air flow is not swirled
- Improved heat flux profile since the fuel gas is reconditioned to produce a uniform flame temperature
- Combustion air is preferably controlled by gears for precise control.
- Bearings are preferably used for the combustion air dampers for smooth, precise operation Further objects, features, and advantages of the present invention will be apparent to those of ordinary skill in the art upon reviewing the accompanying drawings and upon reading the following Detailed Description of the Preferred Embodiments.

DETAILED DESCRIPTION OF THE PREFERRED EMBODIMENTS

Before explaining the present invention in detail, it is important to understand that the invention is not limited in its application to the details of the preferred embodiments and steps described herein. The invention is capable of other embodiments and of being practiced or carried out in a variety of ways. It is to be understood that the phraseology and terminology employed herein is for the purpose of description and not of limitation.

It will also be understood by those of ordinary skill in the art that, unless otherwise specified, the inventive features, structures, and steps discussed herein can be advantageously employed using any number of exterior fuel ejection nozzles, each having one or any other number of flow ejection ports provided therein. In addition, the inventive burners described herein can be oriented upwardly, downwardly, horizontally, or at generally any other desired operating angle.

Figure 1:
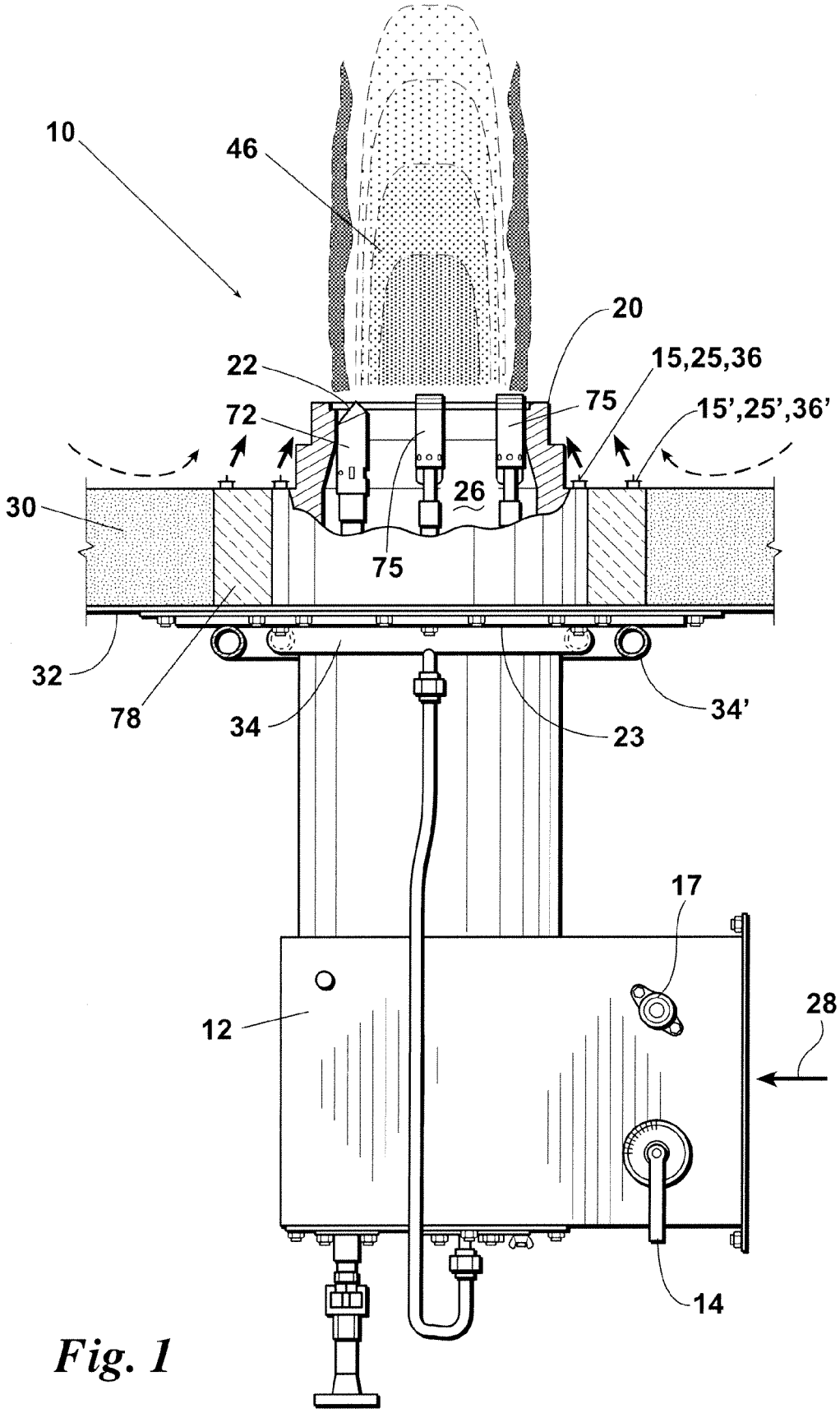
FIG. 1 is a partially cutaway elevational view of an embodiment 10 of the inventive burner.
Figures 2, 3:
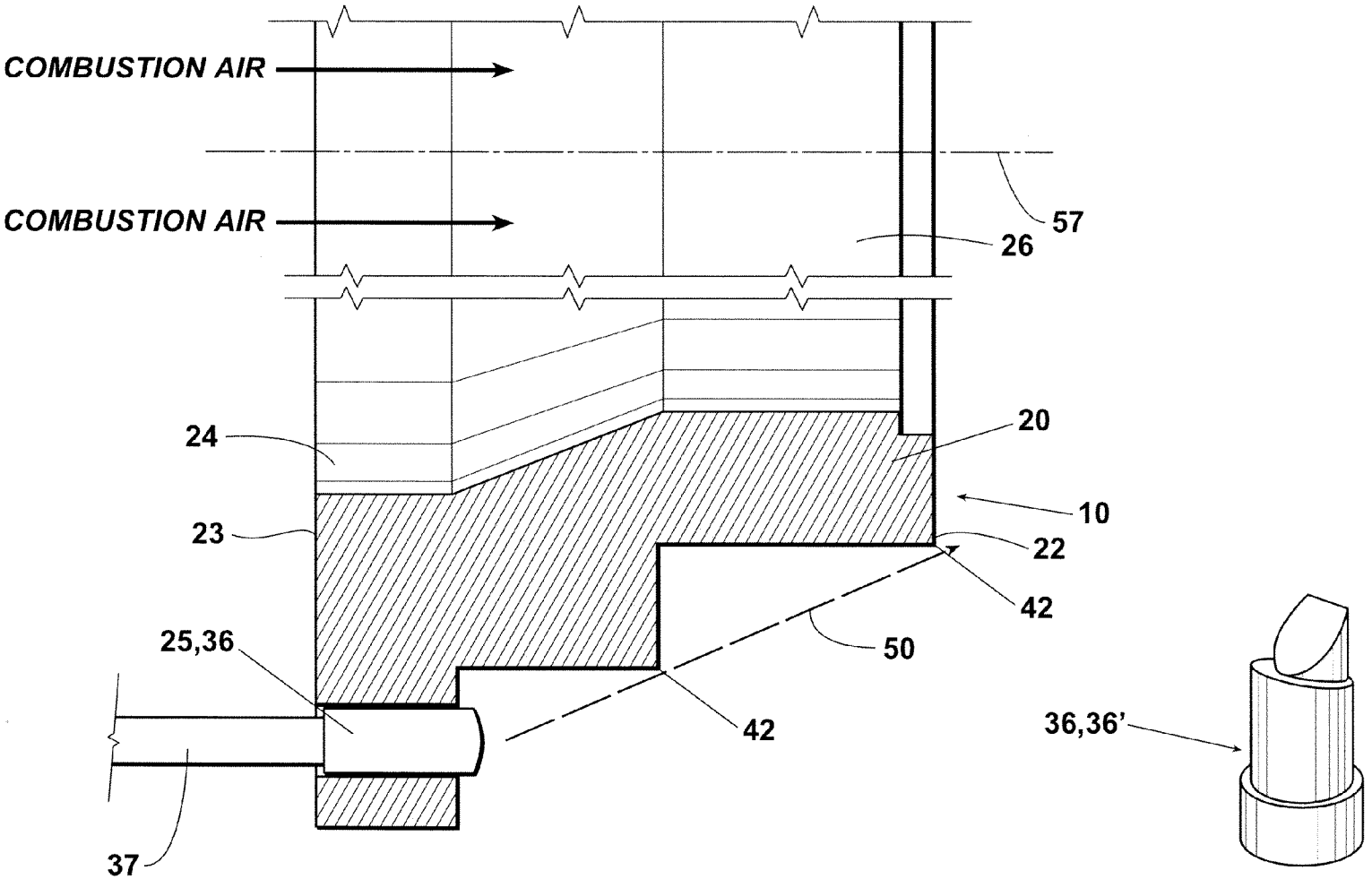
FIG. 2 is a partial, cutaway elevational view schematically illustrating a portion of the burner assembly 10.
FIG. 3 is a perspective view of a fuel gas ejector tip 36, 36' preferred for use in the burner assembly 10.

Referring now to the drawings, FIGS. 1 and 2 depict an embodiment 10 of the inventive burner apparatus. Burner 10 comprises a housing 12 and a burner wall 20. The burner wall 20 has an outlet or forward end 22, a base end 23, and a central passageway or throat 26 extending therethrough. An outwardly (forwardly) extending combustion region 46 preferably begins at or near the forward end 22 of the burner wall 20. The burner wall 20 is preferably constructed of a high temperature refractory burner tile material. The outlet end 22 of burner 10 is in communication with the interior of the boiler, fired heater, or other furnace system enclosure in which combustion takes place and which therefore contains combustion product gases (i.e., flue gas). Burner 10 is shown as installed through a furnace floor or other wall 32, typically formed of metal. Insulating material 30 will typically be secured to the interior of furnace wall 32.

Combustion air or other oxygen-containing gas 28 is received in housing 12 and directed thereby into the inlet end 23 of burner throat 26. The air 28 exits the burner at the outlet end 22 thereof. The quantity of combustion air entering housing 12 can be regulated, for example, by a combustion air inlet damper having an exterior adjustment handle 14. The internal damper is preferably mounted using a bearing assembly 17 for smooth, precise operation. The air 28 can be provided to housing 12 as necessary by forced circulation, natural draft, a combination thereof, or in any other manner employed in the art.

A series 15 of primary ejection tips, nozzles, or other primary fuel gas ejectors 25 partially surrounds, substantially surrounds, or most preferably entirely surrounds burner wall 20. In embodiment 10 of the inventive burner, each primary ejector 25 is depicted as comprising a primary fuel ejection tip 36 secured over the end of a fuel pipe 37. Each fuel pipe 37 is in communication with a primary fuel supply manifold 34 and can, for example, either (a) extend through a lower outer skirt portion of the burner tile 20, (b) be affixed within the insulating material 30 attached to furnace wall 32, or (c) extend through an insulation filler material (e.g., a soft, high temperature insulating blanket material 78) installed between the lower end of the burner tile 20 and the furnace wall insulating material 30. While the fuel pipes 37 are preferably connected to a primary fuel supply manifold 34, it will be understood that any other type of fuel supply system can alternatively be used in the present invention.

A series 15' of secondary ejection tips, nozzles, or other fuel ejectors 25' partially surrounds, substantially surrounds, or entirely surrounds, and is spaced radially outward from, the series 15 of primary ejectors 25. Each secondary ejector 25' preferably comprises a secondary fuel ejection tip 36' secured over the end of a fuel supply pipe which is connected to a secondary fuel supply manifold 34'. Although secondary fuel pipes for the secondary ejector tips 36' are preferably connected to a secondary fuel supply manifold 34', it will be understood that any other type of fuel supply system could alternatively be used for the secondary ejectors 25'.

The series of 15' of secondary ejection tips, nozzles, or other secondary fuel ejectors 25' will preferably be spaced radially outward from the series 15 of primary ejection tips, nozzles, or other primary fuel gas ejectors 25 by a distance of at least about 0.5 inches. The series 15' of secondary fuel ejectors 25' will more preferably be spaced radially outward from the series 15 of primary fuel ejectors 25 by a distance in the range of from about 1.5 to about 7.5 inches and will most preferably be spaced radially outward by a distance in the range of from about 3 to about 5.5 inches.

Although only a single series 15' of secondary ejection tips, nozzles, or other secondary fuel gas ejectors 25' is illustrated in FIG. 1, it will be understood that two, three, or more series of surrounding secondary ejection tips, nozzles, or other secondary fuel gas ejectors could alternatively be used. Each series of secondary fuel ejectors would be spaced radially outward from the previous series such that (a) an optional second series of secondary fuel ejectors could surround and would be spaced radially outward from the first series 15' of secondary fuel ejectors, (b) an optional third series of secondary fuel ejectors could surround and would be spaced radially outward from the second series of secondary fuel ejectors, (c) etc. Each successive series of secondary fuel ejectors will preferably be spaced radially outward from the previous series of secondary fuel ejectors by at least 0.5 inch, more preferably from about 1.5 to about 7.5 inches, and most preferably from about 3 to about 5.5 inches.

Given that the total number of successive series of secondary fuel gas ejectors which partially surround, substantially surround, or completely surround the series 15 of primary fuel ejectors 25 can be any number m, wherein m is 1 or an integer greater than one, the outermost series m of secondary fuel ejectors will most preferably be spaced radially outward from the series 15 of primary fuel ejectors 25 by a distance of not more than 24 inches. In addition, if the number of primary fuel ejectors 25 in series 15 is n, the number of secondary fuel ejectors 25' in the immediately adjacent series 15' of secondary ejectors will preferably be in the range of from about 1.5n to about 2.5n and will more preferably be about 2n. Similarly, this pattern will preferably continue for any and each successive series of secondary fuel ejectors such that (a) the number of secondary fuel gas ejectors in a second series of secondary ejectors spaced radially outward from the first secondary series 15' would most preferably be about 3n, (b) the number of secondary fuel gas ejectors in a third outwardly spaced secondary series would most preferably be about 4n, and so on so that (c) the number of secondary fuel gas ejectors in the last series m of secondary ejectors would most preferably be about (m+1)n.

Each of the primary fuel gas ejector tips 36 and secondary fuel gas ejector tips 36' can have any desired number of ejection ports provided therein. Such ports can also be of any desired shape and can be arranged to provide generally any desired pattern or regime of fuel gas flow outside of burner wall 20. Examples of suitable ejection port shapes include but are not limited to circles, ellipses, squares, rectangles, and supersonic-type ejection orifices.

Each of the ejector tips 36, 36' employed in burner 10 will most preferably have only a single ejection port provided therein. The individual ejection port provided in each ejector tips 36, 36' can be of any shape capable of providing the free jet flow and degree of entrainment and mixing desired. Additionally, the individual ejection orifices of all of the ejector tips 36, 36' can be of the same shape or can be of any desired combination of differing acceptable shapes. The ejection port of each of tips 36, 36' will preferably be, or have a size equivalent to, a circular port having a diameter in the range of from about 0.062 to about 0.50 inch.

As each free jet fuel gas stream from each of the primary and secondary tips 36, 36' flows outside of the burner wall 20, flue gas from the furnace enclosure is entrained therein and thoroughly mixed therewith.

Depending primarily upon the size of the burner and the capacity requirements of the particular application in question, generally any number and spacing of (a) the ejectors 25 in the primary fuel gas series 15 and (b) the ejectors 25' in the secondary fuel gas series 15' can be used. The spacing between adjacent pairs of ejectors will typically be the same, but can be different. Adjacent pairs of primary ejectors 25 will preferably be spaced a sufficient distance apart such that neighboring primary ejectors 25 will not interfere with each other in regard to the free jet entrainment of flue gas in the ejected streams. Each adjacent pair of primary ejectors 25 will preferably be spaced from about 0.25 inch to about 25.0 inches apart. Each pair of adjacent primary ejectors 25 will more preferably be spaced from about 1.5 inch to about 2.2 inches apart.

For the same reasons, each adjacent pair of secondary ejectors 25' will also preferably be spaced from about 0.25 inch to about 25.0 inches apart and will more preferably be spaced from about 1.5 to about 2.2 inches apart.

As depicted in the drawings, the primary ejectors 25 are preferably located in proximity to the base 23 of burner wall 20. The primary fuel ejectors 25 and the surrounding secondary fuel ejectors 25' are positioned longitudinally rearward of and laterally outward from the outer or forward end 22 of the burner wall 20. As one option, the primary and secondary ejectors tips 36, 36' and the individual flow ports provided therein can be positioned such that the fuel gas free jet flow streams from the primary and secondary ejectors 25, 25' will be discharged outside of a base portion of the burner wall 20 at the same angle, at different angles, or at any other combination of angles with respect to the longitudinal axis 57 of the burner assembly 10, said angle or angles all preferably being in the range of from about +90° toward the burner wall 20 to about −45° away from the burner wall 20, more preferably from about +25° toward the burner wall 20 to about −15° away from the burner wall 20.

In one preferred arrangement, the ejectors 25 in the series 15 of primary fuel gas ejectors 25 will eject fuel gas at the same or at alternating angles such that (a) a first primary ejector 25 will eject fuel gas at an angle with respect to the longitudinal axis 57 in the range of from about 0° to about +20° toward the burner wall 20 or combustion region 46, (b) the next succeeding primary ejector 25 will eject fuel gas at an angle of from about +20° toward the burner wall 20 or combustion region 46 to about −10° away from the combustion region 46, (c) the next succeeding primary ejector 25 will eject fuel gas at the same angle as the first primary ejector, (d) etc. In this embodiment, the successive ejectors 25' of the series 15' of secondary ejectors can also eject fuel gas at either the same angle or at alternating angles, but with the angle of ejection of each of the secondary ejectors 25 preferably being in the range of from about 0° to about +20° toward the burner wall 20 or combustion region 46.

Figure 4:
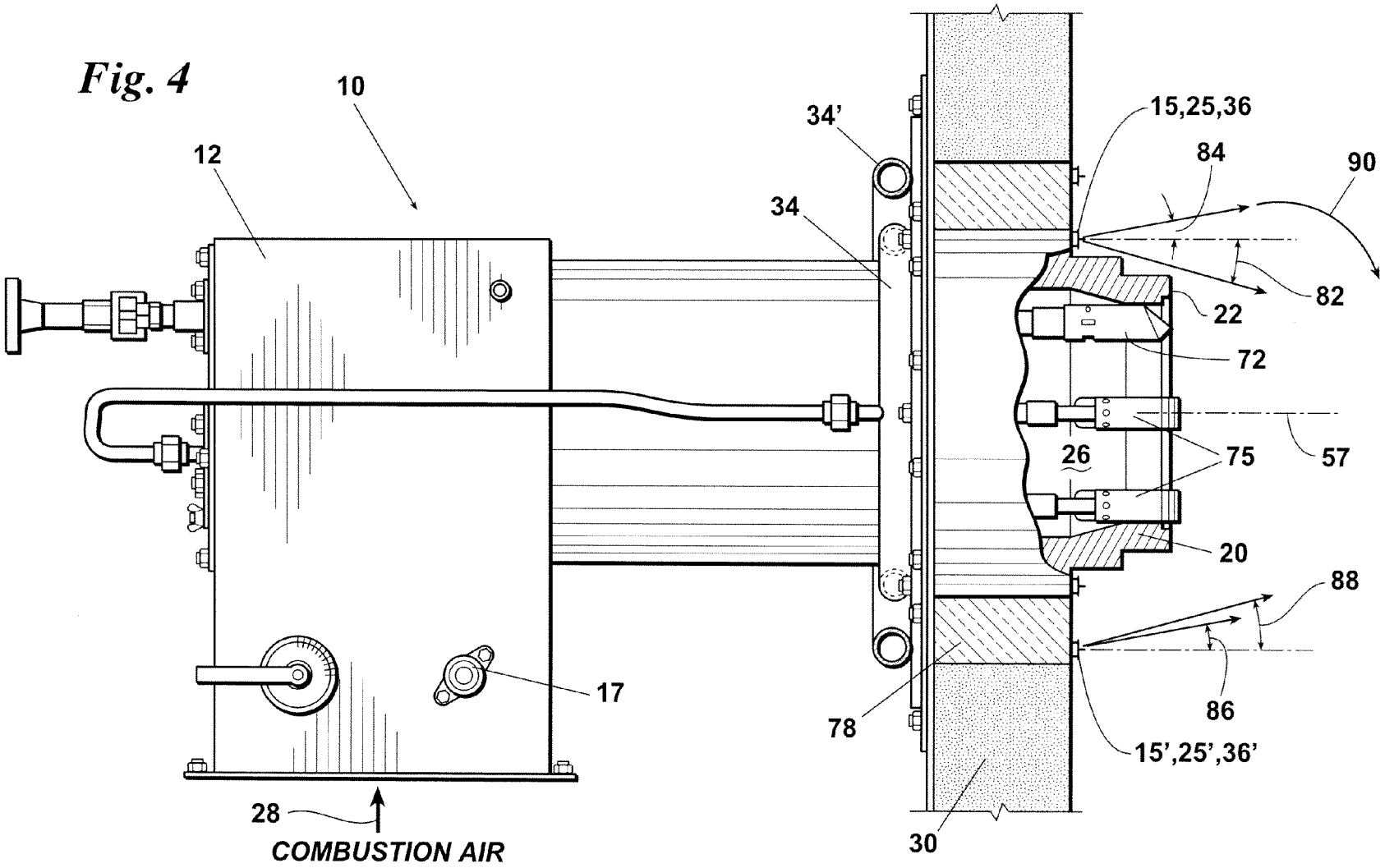
FIG. 4 is a partially cutaway elevational view of the burner assembly 10.
Figure 5:
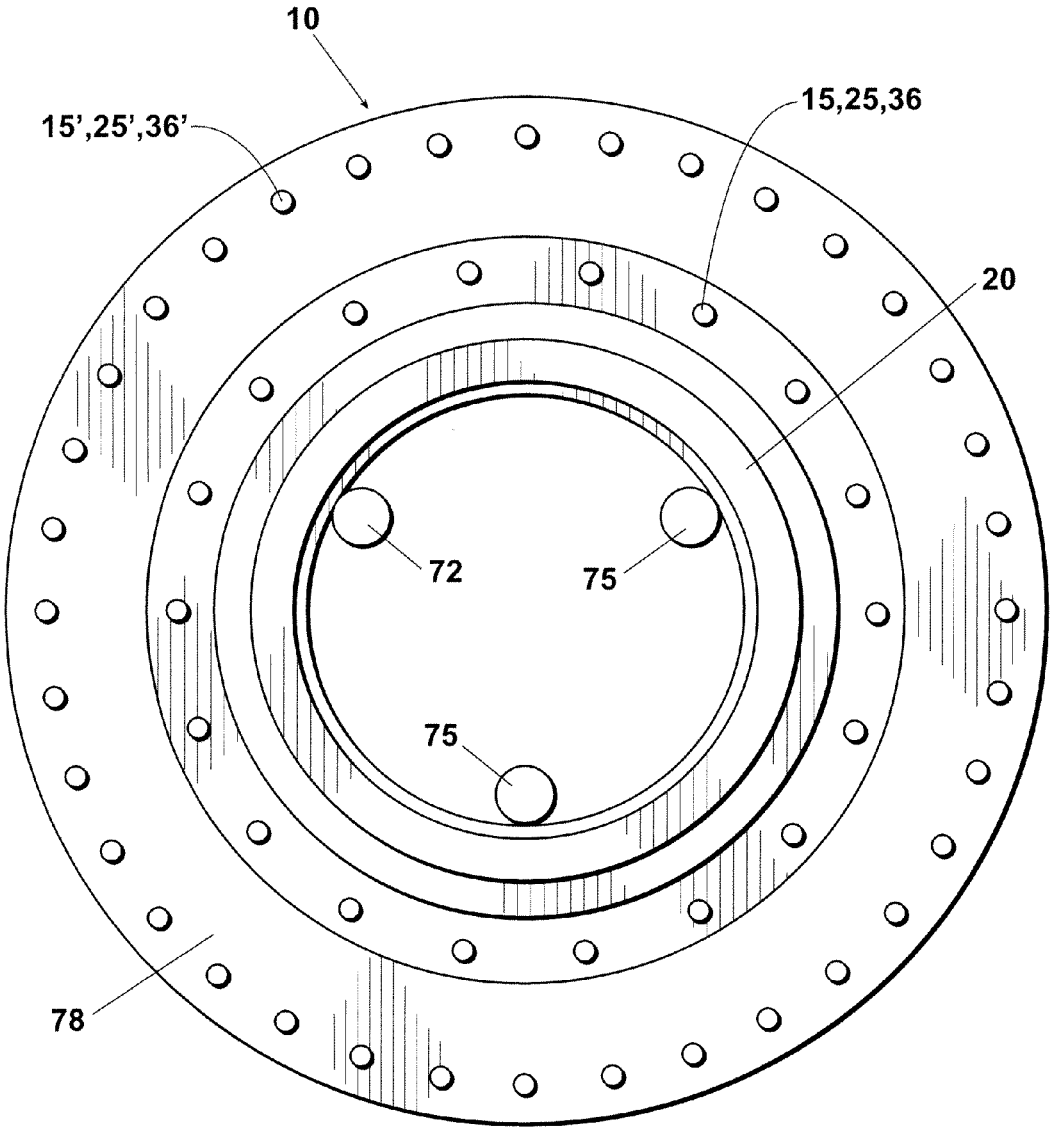
FIG. 5 is a plan view of the inventive burner assembly 10.

For example, in a preferred arrangement illustrated in FIG. 4, the series 15 of primary fuel gas ejectors 25 alternately eject fuel gas forwardly toward and forwardly away from the combustion region 46 or burner wall 20. In this embodiment, the alternating ejection pattern of the primary series 15 of fuel ejectors 25 will preferably be such that (a) a first primary ejector 25 will eject fuel gas forwardly toward the combustion region 46 or burner wall 20 at an angle 82 of from about +10° to about +20° (most preferably about +15°) with respect to the longitudinal axis 57 of the burner 10, (b) the next succeeding primary fuel ejector 25 will eject fuel gas forwardly away from the combustion region 46 at an angle 84 of from about −5° to about −15° (most preferably about −10°) with respect to the longitudinal axis 57 of the burner 10, (c) the next succeeding primary ejector 25 will again eject fuel gas forwardly toward the fuel gas combustion region 46 or burner wall 20 at the angle 82 of from about +10° to about +20° (most preferably about +15°), (d) etc. In this scenario, the series 15 of primary fuel ejectors 25 is sufficiently close to the burner wall 20 that the flow of air out of the forward end 22 of the burner wall 20 will pull the outwardly ejected primary fuel gas streams into the combustion region 46 along arched paths 90 which will cause an even greater amount of flue gas to become entrained in and mixed with the outwardly ejected streams.

In addition, it is also preferred in the arrangement illustrated in FIG. 4 that the secondary ejectors 25' of the series 15' eject secondary fuel gas at alternating angles such that (a) a first secondary ejector 25' will eject fuel gas toward the combustion region 46 or burner wall 20 at an angle 86 of from about −10° to about +15° (most preferably about +0°), (b) the next succeeding secondary fuel ejector 25' will eject fuel gas toward the combustion region 46 or burner wall 20 at an angle 88 of from about +5° to about +15° (most preferably about +10°), (c) the next succeeding secondary ejector 25' will again eject fuel gas toward the combustion region 46 or burner wall 20 at the angle 86 of from about −10° to about +15° (most preferably about +0°), (d) etc.

The burner wall 20 of inventive burner 10 can be circular, square, rectangular, or generally any other desired shape. In addition, as indicated above, either or both of the series 15 of primary fuel ejectors 25 or the series 15' of secondary fuel ejectors 25' employed in the inventive burner need not entirely surround the base of the burner wall 20. For example, the primary ejectors 25 and/or the secondary fuel ejectors 25' may not completely surround the burner wall 20 in certain applications where the inventive burner is used in a furnace sidewall location or must be specially configured to provide a particular desired flame shape.

To further facilitate the entrainment and mixing of flue gas in the fuel gas jet flow streams, the inventive burner 10 preferably comprises one or more exterior impact structures positioned at least partially within the paths of the flow streams 50 from at least some (preferably about one-half of) the primary fuel ejectors 25. Each such impact structure can generally be any type of obstruction which will decrease the flow momentum and/or increase the turbulence of the fuel gas streams 50 sufficiently to promote flue gas entrainment and mixing while allowing the resulting mixture to flow on to combustion region 46. Although other types of impact structures can be employed, the impact structure(s) used in the inventive burner will most preferably be of a type which can be conveniently formed in a poured refractory as part of and/or along with the burner wall 20. The inventive burner will most preferably employ at least two impact structures spaced apart from each other.

The burner wall 20 employed in inventive burner 10 will preferably be formed to provide a particularly desirable tiered exterior shape wherein the diameter of the base 23 of the burner wall 20 is broader than the forward end 22 thereof and the exterior of the burner wall 20 presents a series of concentric, spaced apart, impact ledges 42. The outermost impact ledge 42 can be defined by the outer edge of the forward end 22 of burner wall 20. At least one additional impact ledge 42 is then preferably positioned on the exterior of burner wall 20 between the primary ejectors 25 and forward end 22. Proceeding from the outer end 22 to the base 23 of the burner wall 20, each additional ledge 42 is preferably broader in diameter than and is spaced longitudinally rearward of and laterally outward from the previous ledge.

Combustion is enhanced when the flame is stabilized in the low-pressure areas created on the hot refractory ledges. In addition, as combustion occurs, the refractory retains heat and the stability of the flame is further enhanced. Further, the ledges also help to keep the burner stable during start-up conditions wherein the firebox transitions from an initial oxygen content of 21% to a steady-state flue gas oxygen content of approximately 2% to about 3%.

Each of the primary and secondary fuel ejector tips 36 and 36' used in the inventive burner 10 will preferably be of a type as shown and described in U.S. Pat. No. 6,626,661. U.S. Pat. No. 6,626,661 is incorporated herein by reference in its entirety. A particularly preferred ejector tip structure 36, 36' is shown in FIG. 3.

These tip configurations reduce plugging and coking generally associated with most burner stability problems. They also have less mass and less exposed area which reduces temperature gain and thus reduces coking. In addition, the probability of plugging is further reduced since there is preferably only one port drilled in the tip. Further, the aerodynamic shapes of these tips additionally enhances the mixing of inert gases with the fuel gas ejected from the tips. The "air foil" type shape increases the flow of inert products of combustion around the tip for greater mixing which in turn reduces $NO_x$ emissions.

Further, the preferred use of only one (1) port drilled on the tip contributes to the significantly enhanced turndown ratio of greater than 10:1 provided by the inventive burner assembly 10. In addition, since these tips do not require ignition ports, more tips can be evenly positioned around the burner tile, thus enabling the burner to more evenly mix the fuel gas and combustion air together, which allows the burner to operate with lower excess air.

A burner pilot 72 will preferably be located within the central passageway 26 of the burner wall 20 for initiating combustion at the outer end 22 of the burner. As will be understood by those in the art, the burner assembly 10 can also include one or a plurality of auxiliary pilots 75.

A prior free jet burner providing significant $NO_x$ reduction and a large turndown ratio is described in U.S. Pat. No. 6,499,990 ("the '990 patent"), the entire disclosure of which is incorporated herein by reference. In comparison, however, the performance of the inventive burner assembly 10 significantly exceeds that of even the free jet burner of the '990 patent. When each burner is operated with natural draft and no air preheating, the amount of $NO_x$ production from the inventive burner assembly 10 is only from about 5 to about 10 ppmv, as compared to from about 8 to about 15 ppmv for the prior '990 free jet burner. When each burner is operated with forced draft and preheated air at an output of 50 million Btu/hr, on the other hand, the level of $No_x$ emissions produced by the inventive burner assembly 10 is only about 21 ppmv, as compared to about 38 ppmv for the prior art '990 free jet burner. In addition, the inventive burner 10 provides a turndown ratio of at least 10:1, typically from about 10:1 to about 20:1 or higher.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within this invention as defined by the claims.

What is claimed:

1. A burner apparatus for a furnace system comprising: a burner wall having a forward end, a longitudinal axis extending through said forward end, an exterior, and an interior air passageway, which extends longitudinally through said burner wall and is surrounded by said burner wall and by said exterior of said burner wall so that all air flow for said burner apparatus travels through said interior air passageway, and said interior air passageway having a discharge at said forward end of said burner wall from which all of said air flow for said burner apparatus is discharged and a series of fuel ejection structures positioned outside of said interior air passageway for entraining flue gas in an ejected fuel, wherein said series of fuel ejection structures at least partially surrounds said exterior of said burner wall, each of said fuel ejection structures having a fuel ejection port, said fuel ejection ports of said fuel ejection structures being positioned outside of said interior air passageway, outside of said exterior of said burner wall, and longitudinally rearward of and laterally outward from said discharge of said interior air passageway located at said forward end of said burner wall, wherein said fuel ejection ports of a first set of said fuel ejection structures of said series are oriented for ejecting said fuel outside of said exterior of said burner wall at a first angle with respect to said longitudinal axis and said fuel ejection ports of a second set of said fuel ejection structures of said series are oriented for ejecting said fuel outside of said exterior of said burner wall at a second angle with respect to said longitudinal axis which is different from said first angle, said series of said fuel ejection structures is a series of primary fuel ejection structures and said burner apparatus further comprises a series of secondary fuel ejection structures which at least partially surround said exterior of said burner wall, said series of said secondary fuel ejection structures being spaced radially outward from said series of said primary fuel elector structures, each of said secondary fuel ejection structures having a fuel ejection port, and said fuel election ports of said secondary fuel ejection structures being positioned outside of said interior air passageway, outside of said exterior of said burner wall, and longitudinally rearward of and laterally outward from said discharge of said interior air passageway located at said forward end of said burner wall.

2. The burner apparatus of claim 1 wherein said fuel ejection structures of said first set are positioned in an alternating relationship with said fuel ejection structures of said second set in said series of said fuel ejection structures.

3. The burner apparatus of claim 1 wherein:

said first angle is a forward angle in a range, with respect to said longitudinal axis, of from about +25° toward said exterior of said burner wall to about −15° away from said exterior of said burner wall and said second angle is a forward angle in a range, with respect to said longitudinal axis, of from about +25° toward said exterior of said burner wall to about −15° away from said exterior of said burner wall.

4. The burner apparatus of claim 3 wherein each of said fuel ejection structures has only one fuel ejection port.

5. The burner apparatus of claim 3 wherein:

said first angle is an angle, with respect to said longitudinal axis, toward said exterior of said burner wall and said second angle is an angle, with respect to said longitudinal axis, away from said exterior of said burner wall.

6. The burner apparatus of claim 5 wherein each of said fuel ejection structures has only one fuel ejection port.

7. The burner apparatus of claim 5 wherein:

said first angle is in a range, with respect to said longitudinal axis, of from about +10° to about +20° toward said exterior of said burner wall and said second angle is in a range, with respect to said longitudinal axis, of from about −5° to about −15° away from said exterior of said burner wall.

8. The burner apparatus of claim 7 wherein each of said fuel ejection structures has only one fuel ejection port.

9. The burner apparatus of claim 1 wherein each of said primary fuel ejection structures and each of said secondary fuel ejection structures has only one fuel ejection port.

10. A burner apparatus for a furnace system comprising:

a burner wall having a forward end, a longitudinal axis extending through said forward end, an exterior, and an interior air passageway which extends longitudinally through said burner wall and is surrounded by said burner wall and by said exterior of said burner wall so that all air flow for said burner apparatus travels through said interior air passageway, and said interior air passageway having a discharge at said forward end of said burner wall from which all of said air flow for said burner apparatus is discharged;

a series of primary fuel ejection structures positioned outside of said interior air flow passageway to entrain flue gas present in said furnace system in an ejected primary fuel, wherein said series of primary fuel ejection structures at least partially surround said exterior of said burner wall, each of said primary fuel ejection structures having a fuel ejection port, said fuel ejection ports of said primary fuel ejection structures being positioned outside of said interior air passageway and longitudinally rearward of and laterally outward from said discharge of said interior air passageway located at said forward end of said burner wall to eject said primary fuel outside of said exterior of said burner wall, and a series of secondary fuel ejection structures positioned outside of said interior air flow passage to entrain flue gas present in said furnace system in an ejected secondary fuel, wherein said series of secondary fuel ejection structures at least partially surround said exterior of said burner wall, each of said secondary fuel ejection structures having a fuel ejection port, said fuel ejection ports of said secondary fuel ejection structures being positioned outside of said interior air passageway and longitudinally rearward of and laterally outward from said discharge of said interior air passageway located at said forward end of said burner wall to eject said secondary fuel outside of said exterior of said burner wall, wherein said series of said secondary fuel ejection structures is spaced radially outward from said series of said primary fuel ejection structures.

11. The burner apparatus of claim 10 wherein said burner apparatus has a total number n of said primary fuel ejections structures and a total number of said secondary fuel ejection structures of at least 2n.

12. The burner apparatus of claim 10 wherein said fuel ejection ports of a first set of said secondary fuel ejection structures are oriented to eject said secondary fuel outside of said exterior of said burner wall at a first angle with respect to said longitudinal axis and said fuel ejection ports of a second set of said secondary fuel ejection structures are oriented to eject said secondary fuel outside of said exterior of said burner wall at a second angle with respect to said longitudinal axis which is different from said first angle.

13. The burner apparatus of claim 12 wherein said secondary fuel ejection structures of said first set are positioned in an alternating relationship with said secondary fuel ejection structures of said second set in said series of said secondary fuel ejection structures.

14. The burner apparatus of claim 12 wherein:

said fuel ejection ports of a first group of said primary fuel ejection structures are oriented to eject said primary fuel at one angle with respect to said longitudinal axis and said fuel ejection parts of a second group of said primary fuel ejection structures are oriented to eject said primary fuel at an angle different from said one angle.

15. The burner apparatus of claim 14 wherein:

said fuel ejection structures of said first set are positioned in an alternating relationship with said fuel ejection structures of said second set in said series of said secondary fuel ejection structures and said fuel ejection structures of said first group are position in an alternating relationship with said fuel ejection structures of said second group in said series of said primary fuel ejection structures.

16. The burner apparatus of claim 15 wherein:

each of said primary fuel ejection structures has only one fuel ejection port and each of said secondary fuel ejection structures has only one fuel ejection port.

17. The burner apparatus of claim 16 wherein:

said fuel ejection ports of said first group of said primary fuel ejection structures are oriented to eject said primary fuel at a forward angle with respect to said longitudinal axis in a range of from about +10° to about +20° toward said exterior of said burner wall and said fuel ejection ports of said second group of said primary fuel ejection structures are oriented to eject said primary fuel at a forward angle with respect to said longitudinal axis in a range of from about −5° to about −15° away from said exterior of said burner wall.

* * * * *